US011584970B2

(12) United States Patent
Ha et al.

(10) Patent No.: US 11,584,970 B2
(45) Date of Patent: Feb. 21, 2023

(54) HIGH MANGANESE STEEL FOR LOW TEMPERATURE APPLICATIONS HAVING EXCELLENT SURFACE QUALITY AND A MANUFACTURING METHOD THEREOF

(71) Applicant: POSCO, Pohang-si (KR)

(72) Inventors: Yu-Mi Ha, Gwangyang-si (KR); Young-Deok Jung, Gwangyang-si (KR); Sang-Deok Kang, Gwangyang-si (KR); Un-Hae Lee, Gwangyang-si (KR); Yong-Jin Kim, Gwangyang-si (KR); Sung-Kyu Kim, Gwangyang-si (KR); Young-Ju Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 136 days.

(21) Appl. No.: 16/649,739

(22) PCT Filed: Oct. 11, 2018

(86) PCT No.: PCT/KR2018/011937

§ 371 (c)(1),
(2) Date: Mar. 23, 2020

(87) PCT Pub. No.: WO2019/078538

PCT Pub. Date: Apr. 25, 2019

(65) Prior Publication Data

US 2020/0263268 A1 Aug. 20, 2020

(30) Foreign Application Priority Data

Oct. 18, 2017 (KR) ..... 10-2017-0135464
Sep. 28, 2018 (KR) ..... 10-2018-0115926

(51) Int. Cl.
*C22C 38/38* (2006.01)
*C22C 38/32* (2006.01)
(Continued)

(52) U.S. Cl.
CPC ..... *C21D 8/005* (2013.01); *C21D 6/002* (2013.01); *C21D 6/005* (2013.01); *C21D 6/008* (2013.01);
(Continued)

(58) Field of Classification Search
CPC ..... C22C 38/00; C22C 38/001; C22C 38/002; C22C 38/02; C22C 38/06; C22C 38/20;
(Continued)

(56) References Cited

U.S. PATENT DOCUMENTS 5,431,753 A * 7/1995 Kim ..... C22C 38/04 148/620
5,647,922 A 7/1997 Kim et al.
(Continued)

FOREIGN PATENT DOCUMENTS

CN 102216474 A 10/2011
CN 105473748 A 4/2016
(Continued)

OTHER PUBLICATIONS

Extended European Search Report dated Jun. 26, 2020 issued in European Patent Application No. 18868100.1.
(Continued)

*Primary Examiner* — Michael E. La Villa
(74) *Attorney, Agent, or Firm* — Morgan, Lewis & Bockius LLP

(57) ABSTRACT

The present invention relates to a high manganese steel for low temperature applications and a method for manufacturing the same. The high manganese steel contains 0.3 wt % to 0.8 wt % of C, 18 wt % to 26 wt % of Mn, 0.01 wt % to 1 wt % of Si, 0.01 wt % to 0.5 wt % of Al, 0.1 wt % or less of Ti (excluding 0%), 1 wt % to 4.5 wt % of Cr, 0.1 wt % to 0.9 wt % of Cu, 0.03 wt % or less of S (excluding 0%), 0.3 wt % or less of P (excluding 0%), 0.001 wt % to 0.03 wt
(Continued)

50μm

% of N, 0.004 wt % or less of B (excluding 0%), and a remainder of Fe and other inevitable impurities, wherein a microstructure comprises an austenite single phase structure, and an average grain size of the austenite is 50 μm or less.

19 Claims, 5 Drawing Sheets

(51) Int. Cl.

| | |
|---|---|
| ***C22C 38/28*** | (2006.01) |
| ***C22C 38/20*** | (2006.01) |
| ***C22C 38/06*** | (2006.01) |
| ***C22C 38/02*** | (2006.01) |
| ***C22C 38/00*** | (2006.01) |
| ***C21D 6/00*** | (2006.01) |
| ***C21D 8/00*** | (2006.01) |
| ***C21D 7/13*** | (2006.01) |
| ***C21D 8/02*** | (2006.01) |
| ***C21D 9/00*** | (2006.01) |
| ***C21D 9/46*** | (2006.01) |
| ***C22C 38/14*** | (2006.01) |
| ***C22C 38/16*** | (2006.01) |
| ***C22C 38/04*** | (2006.01) |
| ***C22C 38/18*** | (2006.01) |

(52) U.S. Cl.
CPC ..... *C21D 7/13* (2013.01); *C21D 8/02* (2013.01); *C21D 8/021* (2013.01); *C21D 8/0205* (2013.01); *C21D 8/0226* (2013.01); *C21D 8/0263* (2013.01); *C21D 9/00* (2013.01); *C21D 9/0081* (2013.01); *C21D 9/46* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/14* (2013.01); *C22C 38/16* (2013.01); *C22C 38/18* (2013.01); *C22C 38/20* (2013.01); *C22C 38/28* (2013.01); *C22C 38/32* (2013.01); *C22C 38/38* (2013.01); *C21D 2211/001* (2013.01); *Y10T 428/12951* (2015.01); *Y10T 428/12972* (2015.01); *Y10T 428/12979* (2015.01); *Y10T 428/26* (2015.01)

(58) Field of Classification Search
CPC ..... C22C 38/28; C22C 38/32; C22C 38/38; C22C 38/04; C22C 38/14; C22C 38/16; C22C 38/18; C21D 2211/001; C21D 9/00; C21D 9/0081; C21D 9/46; C21D 8/005; C21D 8/02; C21D 8/0205; C21D 8/021; C21D 8/0226; C21D 8/0263; C21D 6/002; C21D 6/005; C21D 6/008; C21D 7/13; Y10T 428/12951; Y10T 428/12972; Y10T 428/12979; Y10T 428/26
See application file for complete search history.

(56) References Cited

U.S. PATENT DOCUMENTS

| | | | |
|---|---|---|---|
| 2011/0308673 | A1 | 12/2011 | Schneider et al. |
| 2016/0186285 | A1 | 6/2016 | Kim et al. |
| 2016/0319407 | A1 | 11/2016 | Lee et al. |
| 2017/0362675 | A1 | 12/2017 | Lee et al. |
| 2018/0363108 | A1 | 12/2018 | Lee et al. |

FOREIGN PATENT DOCUMENTS

| | | | |
|---|---|---|---|
| CN | 105849302 | A | 8/2016 |
| CN | 105861943 | A | 8/2016 |
| CN | 111663085 | A | 9/2020 |
| EP | 2799571 | A1 | 11/2014 |
| EP | 3088555 | A1 | 11/2016 |
| JP | H06-004903 | B2 | 1/1994 |
| JP | 2013-023743 | A | 2/2013 |
| KR | 10-1995-0026569 | A | 10/1995 |
| KR | 10-1998-0058369 | A | 9/1998 |
| KR | 10-2004-0059582 | A | 7/2004 |
| KR | 10-0711371 | B1 | 4/2007 |
| KR | 10-2009-0070509 | A | 7/2009 |
| KR | 10-2011-0009792 | A | 1/2011 |
| KR | 10-2013-0076570 | A | 7/2013 |
| KR | 10-1609242 | B1 | 4/2016 |
| KR | 10-2016-0078664 | A | 7/2016 |
| WO | 2009/084793 | A1 | 7/2009 |
| WO | 2016/105002 | A1 | 6/2016 |
| WO | 2017/111510 | A1 | 6/2017 |

OTHER PUBLICATIONS

Chinese Office Action dated Mar. 3, 2021 issued in Chinese Patent Application No. 201880067461.7 (with English translation).
Wang Youming, et al., "Controlled Rolling and Controlled Cooling of Steels," Teaching books for institution of higher education, Metallurgical Industry Press, 2009, pp. 1-5 (with English translation).
Wang Tingpu, et al., "Modern Steel Rolling," Metallurgical Industry Press, 2014, pp. 1-5 (with English translation).
International Search Report dated Jan. 18, 2019 issued in International Patent Application No. PCT/KR2018/011937 (with English translation).

* cited by examiner

200μm

HIGH MANGANESE STEEL FOR LOW TEMPERATURE APPLICATIONS HAVING EXCELLENT SURFACE QUALITY AND A MANUFACTURING METHOD THEREOF

CROSS-REFERENCE OF RELATED APPLICATIONS

This application is the U.S. National Phase under 35 U.S.C. § 371 of International Patent Application No. PCT/KR2018/011937, filed on Oct. 11, 2018, which in turn claims the benefit of Korean Application No. 10-2017-0135464, filed on Oct. 18, 2017 and Korean Application No. 10-2018-0115926, filed on Sep. 28, 2018, the entire disclosures of which applications are incorporated by reference herein.

TECHNICAL FIELD

The present invention relates to a high manganese steel for low temperature applications, which can be utilized in liquefied gas storage tanks and transportation facilities, in a wide range of temperatures from low temperature to room temperature, more specifically, to a high manganese steel for low temperature applications having excellent surface quality, and a method of manufacturing the same.

BACKGROUND ART

There has been an increased interest in energy sources, such as LNG and LPG, as alternative energy sources, due to tightening regulations on environmental pollution and safety as well as the exhaustion of fossil fuels. As demand for non-polluting fuels, such as natural gas and propane gas, which are carried in a low temperature liquid state, increases, production and material development of storage and transportation devices is increasing for non-polluting fuels.

Materials having excellent mechanical properties such as strength and toughness at low temperatures are used in low temperature storage tanks, and representative materials may be aluminum alloy, austenitic stainless steel, 35% Inva steel, and 9% Ni steel.

Among such materials, 9% nickel steel is the most widely used, in terms of economic feasibility and weldability. As most of these materials are high in terms of the amount of nickel added thereto, they may be expensive; thus, it is urgent to develop alternative materials having excellent yield strength and low temperature toughness.

Meanwhile, one method for manufacturing a material having high low temperature toughness to allow the material to have a stable austenite structure at low temperatures.

An example thereof is a technique of stabilizing austenite by adding large amounts of carbon and manganese. When large amounts of carbon and manganese are added to stabilize austenite, however, slabs to products have an austenite single phase, that is, phase transformation may not occur.

Since phase transformation may not occur, the slab may have a coarse casting structure. For this reason, surface grain boundary cracking occurs when the slab is hot-rolled. Further, the slab, which does not involve phase transformation, has a coarse casting structure, and thus has poor high temperature ductility.

When surface grain boundary cracking occurs during hot-rolling of the slab, the surface quality of the steel is deteriorated, resulting in thickness irregularities of a final structure.

In particular, such thickness irregularities may cause a significant problem in the structural design and use of a structure requiring pressure resistance through securing a uniform thickness of steel, such as a low temperature pressure vessel.

PRIOR ART (Patent Document 1) Korean Laid-Open Patent Publication Application No. 2011-0009792

DISCLOSURE

Technical Problem

An aspect of the present disclosure is to provide a high manganese steel for low temperature applications having not only excellent yield strength and impact toughness but also excellent surface quality.

Another aspect of the present disclosure is to provide a method for manufacturing a high manganese steel for low temperature applications having not only excellent yield strength and impact toughness but also excellent surface quality at a low price.

Technical Solution

According to an aspect of the present disclosure, a high manganese steel for low temperature applications contains 0.3 wt % to 0.8 wt % of C, 18 wt % to 26 wt % of Mn, 0.01 wt % to 1 wt % of Si, 0.01 wt % to 0.5 wt % of Al, 0.1 wt % or less of Ti (excluding 0%), 1 wt % to 4.5 wt % of Cr, 0.1 wt % to 0.9 wt % of Cu, 0.03 wt % or less of S (excluding 0%), 0.3 wt % or less of P (excluding 0%), 0.001 wt % to 0.03 wt % of N, 0.004 wt % or less of B (excluding 0%), and a remainder of Fe and other inevitable impurities, wherein a microstructure may include an austenite single phase structure, an average grain size of the austenite may be 50 μm or less, and a number of an austenite grain having a grain size of 50 μm or more may be less than 1 per cubic centimeter.

The high manganese steel may contain 1 volume % or less (including 0%) of a precipitate.

The high manganese steel may have rolling direction impact toughness of 100 J or higher at −196° C. and an anisotropy index, a ratio of thickness direction impact toughness at −196° C. to rolling direction impact toughness at −196° C., of 0.6 or higher.

The high manganese steel may have yield strength of 400 MPa or higher.

The high manganese steel is manufactured by a manufacturing method involving preparing a slab having above mentioned composition, reheating the slab and hot rolling the reheated slab, wherein a recrystallization structure having less than 1 grain having a grain size of 150 μm or more may be formed per $cm^2$ on a surface layer portion of the slab before reheating.

An average grain size of the surface layer portion of the slab before reheating may be 100 μm or less.

The slab before reheating may have a cross-section reduction rate of at least 60% at 1100° C.

According to another aspect of the present disclosure, a method of manufacturing a high manganese steel for low temperature applications is provided, the method comprising preparing a slab comprising 0.3 wt % to 0.8 wt % of C, 18 wt % to 26 wt % of Mn, 0.01 wt % to 1 wt % of Si, 0.01 wt % to 0.5 wt % of Al, 0.1 wt % or less of Ti (excluding 0%), 1 wt % to 4.5 wt % of Cr, 0.1 wt % to 0.9 wt % of Cu, 0.03 wt % or less of S (excluding 0%), 0.3 wt % or less of P (excluding 0%), 0.001 wt % to 0.03 wt % of N, 0.004 wt % or less of B (excluding 0%), and a remainder of Fe and other inevitable impurities; deformation application involving applying a deformation to the slab such that a fine recrystallization structure is formed on a surface layer portion of the slab; air cooling involving air-cooling the slab on which the fine recrystallization structure is formed on the surface layer portion thereof to room temperature; reheating involving heating the air-cooled slab to 1100° C. to 1250° C.; hot rolling involving finish-rolling the reheated slab at 850° C. to 950° C. to obtain a hot-rolled steel; and accelerated cooling involving accelerated-cooling the hot-rolled steel at a cooling speed of 10° C./sec or more to an accelerated cooling termination temperature of 600° C. or less.

It is preferable that the deformation application be performed such that a number of grains having a grain size of at least 150 μm is less than 1 per $cm^2$.

An average grain size of the surface layer portion of the slab before reheating may be 100 μm or less.

The deformation application is performed by rough rolling under a high reduction condition at 1000° C. to 1200° C.

The deformation application may be performed by high temperature forging at 1000° C. to 1200° C.

An average grain size of the surface layer portion of the slab after the high temperature forging may be 100 μm or less.

The deformation application may be performed such that a thickness reduction rate is 15% to 50% for an initial slab.

During the hot rolling, a finish-rolling temperature may be controlled when finish rolling according to a thickness of final steel.

During the hot rolling, a final pass rolling temperature during hot finish rolling is 850° C. or above and less than 900° C. when a final thickness of the steel may be 18t (t: steel thickness (mm)) or above, and a final pass rolling temperature during hot finish rolling is 900° C. to 950° C. when a final thickness of the steel may be less than 18t (t: steel thickness (mm)).

Advantageous Effects

According to an aspect, a high manganese steel for low temperature applications, having not only excellent yield strength and impact toughness but also excellent surface quality, may be provided at a low price.

BRIEF DESCRIPTION OF THE DRAWINGS

FIG. 1 illustrates a microstructure of a slab before forging, while FIG. 2 illustrates a microstructure of a slab after forging.

FIG. 3 illustrates a microstructure of the conventional steel (Comparative Example 2) in which coarse grains of austenite are formed, while FIG. 4 illustrates a uniform structure of austenite of the steel (Inventive Example 3) to which forging of a slab is applied according to the present invention.

FIG. 5 illustrates an example of a case in which surface irregularities is generated, while FIG. 6 illustrates an example of a case in which surface irregularities is not generated.

BEST MODE FOR INVENTION

Figure 1:
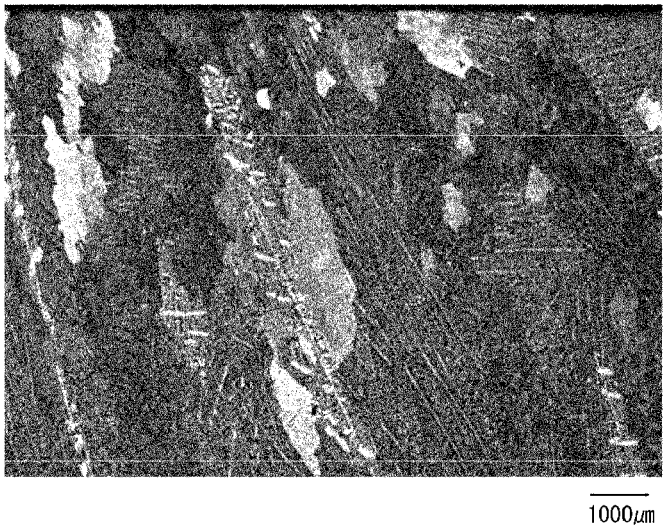
FIGS. 1 and 2 illustrate microstructures of a slab before and after forging.

The present invention relates to a high manganese steel for low temperature applications having excellent surface quality and a manufacturing method thereof. Preferred embodiments of the present invention will be described. Embodiments may be modified in various forms, and the scope of the present invention should not be construed as being limited to those described below. The embodiments are provided to describe in detail the present invention to those skilled in the art.

The present invention is preferably applied to materials including, for example, liquefied petroleum gas and liquefied natural gas, for use in low temperature components such as fuel tanks, storage tanks, ship membranes and transport pipes for storing and transporting at low temperatures.

When stabilizing austenite by adding large amounts of carbon and manganese as in the present invention, slabs to products have an austenite phase, that is, those are not subject to phase transformation.

As phase transformation does not occur, the slab has a coarse casting structure. For this reason, surface grain boundary cracking occurs when hot-rolling the slab.

When the cracking occurs during hot-rolling, surface quality of the steel may deteriorate, thereby giving rise to thickness irregularity of a final structure product. Further, the slab, which does not involve phase transformation, has the coarse casting structure, and thus does not have superior high temperature ductility.

In this regard, the present inventors conducted research and experiments to develop a high manganese steel for low temperature applications having not only high yield strength and excellent impact toughness but also excellent surface quality, and as a result, completed the present invention.

Main concepts of the present disclosure are as follows.

1) In order to stabilize the austenite structure, contents of C, Mn and Cu are particularly controlled. Austenite stabilization may serve to excellent low temperature toughness.

2) A size of a microstructure of the steel and a number of coarse grains are particularly controlled. This may serve to improved surface quality of the steel.

3) Cooling conditions of the hot-rolled steel are particularly controlled. This may serve to prevention of carbide formation in the grains, which may improve impact toughness.

4) The slab is subject to deformation prior to the hot-rolling thereof, such that a recrystallization microstructure is formed on the surface layer portion of the slab. An example of the deformation treatment is rough rolling under high reduction conditions or high temperature forging under high reduction conditions.

By deforming the slab, for example, rough rolling under high reduction conditions, forging under high reduction conditions, or the like, to form a recrystallization microstructure on the surface layer of the slab, before the slab is hot rolled, coarse grain cracking may be prevented from being generated and spread along the casting structure, thereby improving surface quality of the steel. Further, as the recrystallization microstructure is formed on the surface layer of the slab, high temperature ductility of the slab may be improved.

5) Hot-rolling conditions are particularly controlled. In particular, a final rolling temperature is controlled depending on a final steel thickness during hot rolling. This may secure high strength.

Hereinafter, the high manganese steel for low temperature applications according to an embodiment will be described.

A high manganese steel for low temperature applications according to an embodiment of the present invention contains 0.3 wt % to 0.8 wt % of C, 18 wt % to 26 wt % of Mn, 0.01 wt % to 1 wt % of Si, 0.01 wt % to 0.5 wt % of Al, 0.1 wt % or less of Ti (excluding 0%), 1 wt % to 4.5 wt % of Cr, 0.1 wt % to 0.9 wt % of Cu, 0.03 wt % or less of S (excluding 0%), 0.3 wt % or less of P (excluding 0%), 0.001 wt % to 0.03 wt % of N, 0.004 wt % or less of B (excluding 0%), and a remainder of Fe and other inevitable impurities, wherein a microstructure may include an austenite single phase structure, an average grain size of the austenite may be 50 μm or less, and a number of an austenite grain having a grain size of 50 μm or more may be less than 1 per cubic centimeter.

Hereinafter, ingredients of the high manganese steel for low temperature applications and contents thereof will be described in more detail. Unless otherwise indicated, percentages indicating the content of each element are based on weight.

C: 0.3 wt % to 0.8 wt %

Carbon (C) is an element for stabilizing austenite and securing strength. When a content thereof is less than 0.3 wt, stability of the austenite is insufficient, and ferrite or martensite may form, thereby reducing low temperature ductility. Meanwhile, when a content thereof exceeds 0.8 wt %, carbides are formed, which may give rise to surface defects. Accordingly, it is preferable that the content of C be limited to 0.3 wt % to 0.8 wt %.

Mn: 18 wt % to 26 wt %

Manganese (Mn) is an important element for stabilization of the austenite structure. As ferrite needs to be prevented from being formed and stability of the austenite needs to be increased to secure low temperature ductility, at least 18 wt % needs to be added. When the content of Mn is less than 18 wt %, an s-martensite phase and an α'-martensite phase are formed and low temperature ductility is reduced. In contrast, when the content thereof is greater than 26 wt %, a manufacturing cost greatly increases, and internal oxidation is severely generated when the slab is heated during the hot rolling, which leads to deteriorated surface quality. Accordingly, it is preferable that the content of Mn be limited to 18 wt % to 26 wt %.

Si: 0.01 wt % to 1 wt %

Silicon (Si) is an element improving castability of molten steel, and in particular, effectively increasing strength of the steel while being added to austenite steel. However, when Si is added in an amount greater than 1 wt %, stability of austenite decreases and toughness may be reduced. Accordingly, it is preferable that an upper limit of the Si content be controlled to be 1 wt %.

Al: 0.01 wt % to 0.5 wt %

Aluminum (Al), in an appropriate amount thereof, is an element stabilizing austenite and affecting carbon activity in the steel to effectively inhibit the formation of carbides, thereby increasing toughness. When more than 0.5 wt % of Al is added, castability and surface quality may deteriorate through oxides and nitrides. Accordingly, it is preferable that an upper limit of the Al content be limited to 0.5 wt %.

Ti: 0.1 wt % or less (excluding 0%)

Titanium (Ti) is an element forming a precipitate individually or in combination to refine the austenite grain, thereby increasing strength and toughness. Further, when a sufficient number of sites for precipitate formation are present in the austenite grain, Ti forms fine precipitates inside the grain to improve strength through precipitate hardening. When more than 0.1 wt % of Ti is added, a large amount of oxide is produced in steelmaking, causing processing and cast steel-related problems during continuous casting.

Alternately, carbonitrides are coarsened, causing deterioration of steel elongation, toughness and surface quality. Accordingly, it is preferable that the content of Ti be limited to 0.1% wt or less.

Cr: 1 wt % to 4.5 wt %

Chromium (Cr) is superior in terms of strength improvement through strengthening of a solid solution in the austenite structure. As Cr has a corrosion resistance effect, surface quality may be effectively improved in high temperature oxidation. In order to obtain such an effect, it is preferable that Cr be added in an amount of at least 1 wt %. Meanwhile, when an amount of Cr exceeding 4.5 wt % may be advantageous for carbide production, causes a problem of deteriorated cryogenic toughness. Accordingly, it is preferable that the content of Cr be limited to 1 wt % to 4.5 wt %

Cu: 0.1 wt % to 0.9 wt %

Copper (Cu), together with Mn and C, is an element which improves low temperature toughness while stabilizing austenite. Due to low solid solubility in carbides and slow diffusion in austenite, Cu is concentrated at an interface between austenite and nucleated carbides. By interfering with the diffusion of carbon, Cu effectively slows carbide growth and suppresses carbide formation. Accordingly, it is preferable to use together with Cr. In order to acquire such an addition effect, it is preferable that Cu be added in an amount of at least 0.1 wt % or more. Meanwhile, when Cu is added in an excessive amount of 0.9 wt %, surface quality may be deteriorated due to hot shortness. Accordingly, it is preferable that the content of Cu be limited to 0.1 wt % to 0.9 wt %.

S: 0.03 wt % or less (excluding 0%)

Sulfur (S) needs to be controlled to be in an amount of 0.03 wt % or less for inclusion control.

When a content of S exceeds 0.03 wt, hot shortness may occur and surface quality may be deteriorated.

P: 0.3 wt % or less (excluding 0%)

Phosphorous (P) is an element that segregation easily occurs, and lowers cracking and weldability during casting. To prevent the same, a content thereof needs to be controlled to 0.3 wt % or less. A content of P exceeding 0.3 wt % may reduce castability. Accordingly, it is preferable that an upper limit thereof be limited to 0.3 wt %.

N: 0.001 wt % to 0.03 wt %

Nitrogen (N), together with C, is an element stabilizing austenite and improving toughness. In particular, N is a greatly advantageous element for enhancing strength through solid solution strengthening or precipitate formation such as carbon. However, when added in an excessive amount of 0.03 wt %, physical properties and surface quality deteriorate due to coarsening of carbonitrides. Accordingly, it is preferable that an upper limit thereof be limited to 0.03 wt %. Meanwhile, when added in an amount of less than 0.001 wt %, the effect is insignificant. Accordingly, it is preferable that a lower limit thereof be limited to 0.001 wt %.

B: 0.004 wt % or less (excluding 0%)

Boron (B) has a significant effect on surface quality improvement by suppressing grain boundary fracture through strengthening of grain boundaries, but decreases toughness and weldability due to formation of coarse precipitates when excessively added. Accordingly, it is preferable that a content thereof be limited to 0.004 wt %.

In addition to the above, a remainder of Fe and inevitable impurities are contained. However, in a conventional manufacturing process, impurities, which are not intended from the raw material or the surrounding environment, may be inevitably mixed, and thus cannot be excluded. As these impurities are known to those skilled in the art, not all impurities are specifically mentioned in the present invention. In addition, addition of an effective component other than said composition should not be excluded.

The microstructure of the high manganese steel for low temperature applications according to an embodiment is an austenite single phase, and an average grain size of the austenite structure is 50 μm or less. A number of the austenite grain having a grain size of 50 μm or more may be less than 1 per $cm^2$.

When an average grain size of the austenite structure exceeds 50 μm, high density of the coarse grains causes non-uniform deformation during processing into a structure, which may result in deterioration of the surface quality after processing. Accordingly, the average grain size is limited to 50 μm or less. In contrast, strength of the steel increases accordingly as the average grain size of the austenite structure decreases, but precipitation of grain boundary carbide is facilitated by grain refinement, and low temperature toughness may become inferior due to the increased strength. Accordingly, the average grain size of the austenite structure is limited to 20 μm or more. In this regard, the average grain size of the austenite structure is preferably 20 μm to 50 μm, more preferably 20 μm to 30 μm.

Meanwhile, when a number of the grains of the austenite structure, which have a grain size of at least 50 μm, is 1 or more per $cm^2$, high density of the coarse grains may deteriorate the surface quality after processing into a structure. Accordingly, it is preferable that the number of the grains of the austenite, which have a grain size of at least 50 μm, be limited to less than 1 per $cm^2$. More preferably, the number of the grains of the austenite structure, which have a grain size of at least 30 μm may be less than 1 per $cm^2$.

1 vol % or less precipitates may be contained in the high manganese steel. When the precipitate is contained in an amount exceeding 1 vol %, low temperature toughness may be deteriorated. Accordingly, it is preferable that the amount of the precipitate be limited to 1 vol % or less (excluding 0%).

A thickness of the high manganese steel may be 8.0 mm or more, preferably 8.0 mm to 40 mm.

The high manganese steel for low temperature applications according to the present invention may have Charpy impact absorption energy of 100 J or more in the rolling direction (RD) at −196° C.

As used herein, an anisotropy index refers to a ratio of thickness direction (TD) impact toughness at −196° C. to rolling direction (RD) impact toughness at −196° C. Specifically, the anisotropy index of the steel in the present invention refers to a value obtained by dividing TD Charpy impact absorption energy at −196° C. by RD Charpy impact absorption energy at −196° C.

When the anisotropy index is below a certain level, securing the physical properties may be problematic in a final product. That is, an anisotropy index below a certain level may make it difficult to secure target Charpy impact absorption energy according to a direction of a material of a final product. Accordingly, the high manganese steel for low temperature applications according to an embodiment of the present invention is limited to a certain level or more, thereby effectively prevent non-uniform Charpy impact absorption energy according to the direction of a material of the final product. A lower limit of the material anisotropy index may be 0.6, preferably 0.8, to prevent non-uniform physical properties of the final product according to the direction of the material.

Hereinbelow, a method for manufacturing a high manganese steel for low temperature applications will be described.

A method for manufacturing a high manganese steel for low temperature applications according to another embodiment may include preparing a slab comprising 0.3 wt % to 0.8 wt % of C, 18 wt % to 26 wt % of Mn, 0.01 wt % to 1 wt % of Si, 0.01 wt % to 0.5 wt % of Al, 0.1 wt % or less of Ti (excluding 0%), 1 wt % to 4.5 wt % of Cr, 0.1 wt % to 0.9 wt % of Cu, 0.03 wt % or less of S (excluding 0%), 0.3 wt % or less of P (excluding 0%), 0.001 wt % to 0.03 wt % of N, 0.004 wt % or less of B (excluding 0%), and a remainder of Fe and other inevitable impurities; deformation application involving applying a deformation to the slab such that a fine recrystallization structure is formed on a surface layer portion of the slab; air cooling involving air-cooling the slab on which the fine recrystallization structure is formed on the surface layer portion thereof to room temperature; reheating involving heating the air-cooled slab to 1100° C. to 1250° C.; hot rolling involving finish-rolling the reheated slab at 850° C. to 950° C. to obtain a hot-rolled steel; and accelerated cooling involving accelerated-cooling the hot-rolled steel at a cooling speed of 10° C./sec or more to an accelerated cooling termination temperature of 600° C. or less.

Deformation Application and Air-Cooling

A slab may be applied with deformation so that a recrystallization microstructure is formed on a surface layer portion of the slab, followed by air-cooling to room temperature. As used here, the slab surface layer portion refers to a region of the slab surface layer portion up to 2 mm from the surface in a slab thickness direction.

As the slab contains a coarse casting structure, cracking is likely to occur and high temperature ductility is inferior when hot rolling. In this regard, deformation is applied to the slab such that a recrystallization microstructure is formed on the surface layer portion of the slab, thereby preventing cracking from occurring during hot rolling and improving high temperature ductility. A recrystallization microstructure may be formed in a region other than the surface layer portion.

It is preferable that the deformation application is performed such that a recrystallization structure in which a number of grains having a grain size of at least 150 μm be less than 1 per $cm^2$. When a number of grains having a grain size of at least 150 μm is one or more, high temperature ductility deteriorate due to coarse grains, and cracking and propagation are generated during hot-rolling, thereby adversely affecting surface quality of a product. An average grain size of the surface layer portion of the slab after the deformation application may be 100 μm or less.

A treatment for the deformation application is not particularly limited, and any treatment is feasible as long as deformation is applied to the slab before reheating the slab and a recrystallization microstructure is formed on the surface layer portion of the slab.

An example of the deformation application is rough rolling at 1000° C. to 1200° C. under high reduction conditions. When a temperature for the rough rolling under the high reduction conditions is less than 1000° C., a treatment temperature is too low to obtain a recrystallization microstructure and deformation resistance may excessively increase during rough rolling. When the temperature exceeds 1200° C., it may be advantageous in obtaining the recrystallization microstructure, but may cause deeper grain boundary oxidation and partial melting in a segregation zone in the cast structure, resulting in surface quality deterioration.

When the slab is rough-rolled under high reduction conditions as described above, recrystallization occurs at least on the surface layer portion of the slab, thereby forming a recrystallization microstructure on the surface layer portion of the slab.

Another example of the deformation application is high temperature forging at 1000° C. to 1200° C. When the forging is performed at a temperature less than 1000° C., a treatment temperature is too low to obtain a recrystallization microstructure and deformation resistance may increase excessively during forging. When the temperature exceeds 1200° C., it may be advantageous in obtaining the recrystallization microstructure, but may cause deeper grain boundary oxidation and partial melting in a segregation zone in the cast structure, resulting in surface quality deterioration When the slab is forged at a high temperature, recrystallization occurs at least on the surface layer portion of the slab, thereby forming a recrystallization microstructure on the surface layer portion of the slab.

It is preferable that the deformation application be performed such that a number of austenite grains having a grain size of 150 μm or more formed on the surface layer portion of the slab be less than 1 per $cm^2$. An average grain size on the surface layer portion of the slab after deformed may be 100 μm or less.

The deformation application may be performed such that a thickness reduction rate is 15% with respect to an initial slab. When the thickness reduction rate is less than too small, sufficient deformation cannot be secured, thereby making it difficult to obtain a recrystallization structure of the surface layer. However, an excessive thickness reduction rate causes the microstructure of the final steel to be excessively refined, thereby deteriorating low temperature toughness. In this regard, the thickness reduction rate may be limited to 50% or less. Accordingly, the thickness reduction rate may be 15% to 50%.

The slab in which a recrystallization microstructure is formed on the surface layer may have a cross-section reduction rate (high temperature ductility) of at least 60% at 1100° C.

Another example of the deformation application is a short blasting method.

Slab Reheating

As previously described, the air-cooled slab is reheated to 1100° C. to 1250° C. When a slab reheating temperature is too low, a rolling load may be excessively applied during hot rolling. In this regard, it is preferable that the heating temperature be at least 1100° C. The higher the heating temperature is, the easier the hot rolling is; however, in the case of steel, as the steel of the present invention, which contains a large amount of Mn, may have deteriorated surface quality due to severe internal grain boundary oxidation during high temperature heating. Accordingly, it is preferable that the reheating temperature be 1250° C. or less.

Hot-Rolling

As previously described, the reheated slab may be finish hot-rolled at 850° C. to 950° C. to obtain hot-rolled steel. A thickness thereof may be at least 8 mm, preferably 8 mm to 40 mm.

During hot rolling, as a finish hot rolling temperature increases, deformation resistance decreases, thereby making the rolling easier; however, a higher rolling temperature may deteriorate the surface quality. In this regard, the finish rolling may be preferably performed at a temperature of 950° C. or less. Meanwhile, when the finish hot rolling temperature is too low, a load increases during the rolling. In this regard, the finish rolling may be preferably performed at a temperature of 850° C. or above.

A rolling temperature may be controlled according to a thickness of the final steel during hot rolling. This may improve strength.

In the hot rolling of the present invention, a final pass rolling temperature during hot finish rolling may be 850° C. or above and less than 900° C. when a final thickness of the steel is 18t (t: steel thickness (mm)) or above, and a final pass rolling temperature during hot finish rolling may be 900° C. to 950° C. when a final thickness of the steel is less than 18t (t: steel thickness (mm)).

When the final thickness of the steel is greater than 18t (t: steel thickness (mm)), sufficient strength cannot be obtained at a final pass rolling temperature of at least 900° C. during finish hot rolling. When the final thickness of the steel is less than 18t (t: steel thickness (mm)), strength may greatly increase at a final pass rolling temperature of less than 900° C. during finish hot rolling, thereby reducing low temperature impact toughness.

When the final thickness of the steel is greater than 18t (t: steel thickness (mm)), carbides may be precipitate at a final pass rolling temperature of less than 850° C., which is lower than a temperature of carbide formation. The carbide precipitation may reduce low temperature impact toughness. When the final thickness of the steel is less than 18t (t: steel thickness (mm)), the rolling is performed for a short period of time at a final pass rolling temperature of greater than 950° C., thereby making it difficult to secure a temperature.

It is preferable that when a final thickness of the steel is 18t (t: steel thickness (mm)) or above, the hot rolling be performed at a temperature below a non-recrystallization temperature (Tnr) such that a reduction ratio is at least 40% of a total reduction rate. When the reduction ratio is less than 40% at a temperature lower than Tnr, insufficient accumulation of dislocations may occur, thereby leading to low strength.

Accelerated Cooling

The hot-rolled steel is accelerated-cooled at a cooling speed of 10° C./sec or more to a accelerated cooling termination temperature of 600° C. or less. The hot-rolled steel is a steel containing 1 wt % to 4.5 wt % of Cr and containing C and thus is essentially subject to accelerated cooling so as to prevent carbide precipitates which may reduce low temperature ductility.

When the cooling speed of accelerated cooling is less than 10° C./sec, carbides are precipitated in the grain boundaries, which may deteriorate impact toughness. The cooling speed may be 10° C./sec to 40° C./sec. When the accelerated cooling termination temperature is greater than 600° C., carbides are precipitated in the grain boundaries due to said reason, and impact toughness may deteriorate. The accelerated cooling termination temperature may be up to 600° C., preferably 300° C. to 400° C.

The steel manufactured as previously described has an austenite single phase, and an average grain size of the austenite structure may be 20 μm to 50 μm, preferably 20 μm to 30 μm. Such manufactured steel may have a microstructure whose number of the austenite grain having a grain size of at least 50 μm, more preferably at least 30 μm, is less than 1 per $cm^2$.

Such manufactured steel may have impact toughness of 100 J or higher at −196° C. in a rolling direction (RD), and an anisotropy index of 0.6 or higher, more preferably 0.8 or higher, at −196° C., where the anisotropy index is a ratio of thickness direction (TD) impact toughness at −196° C. to the RD impact toughness at −196° C.

Such manufactured steel may have yield strength of 400 MPa or higher.

MODE FOR INVENTION

Hereinbelow, the present disclosure will be described in more detail with reference to embodiments. The example embodiment below is merely an example for describing the present disclosure in detail, and may not limit the scope of rights of the present invention.

A slab having the steel composition of Table 1 is forged under the conditions of Table 2 and air-cooled to room temperature, and then reheated, hot rolled and cooled under the conditions of Table 2 to obtain a hot-rolled steel having a thickness of Table 2.

A number of austenite grains having a grain size of at least 150 μm on the slab surface layer before the slab is heated and high temperature ductility of the slab were evaluated. A result thereof is shown in Table 2 below.

Meanwhile, a number of austenite grains having a grain size of at least 50 μm and that of at least 30 μm (per $cm^2$), an average grain size, a precipitate percentage (volume %), yield strength, Charpy impact toughness and surface irregularities were observed for the manufactured hot-rolled steel and the result thereof is shown in Table 3 below. The Charpy toughness was measured for the hot-rolled steel in the rolling direction and that in the thickness direction. An anisotropy index was measured by calculating Charpy impact absorption energy at −196° C. in the TD to that in the RD.

Figure 5:
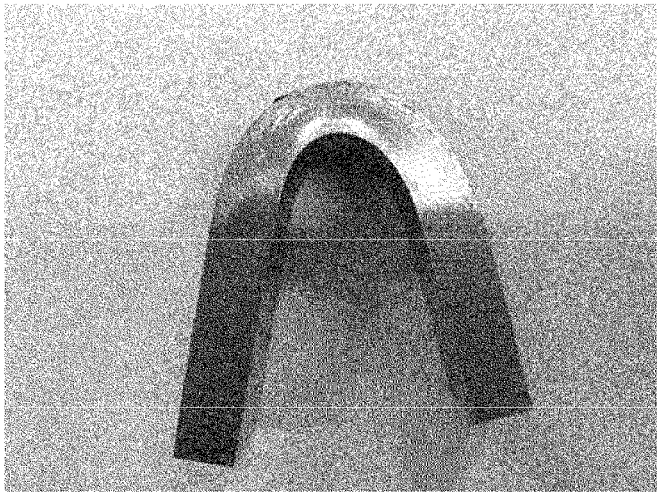
FIGS. 5 and 6 are photographic images illustrating examples of result of determining whether surface irregularities is generated.
Figure 6:
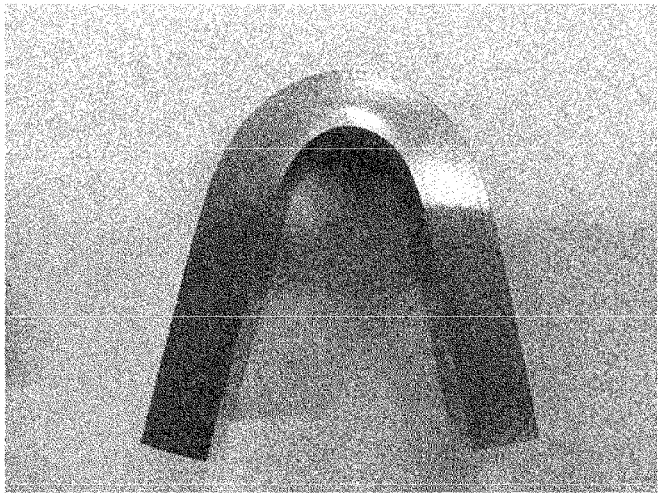

The high temperature ductility (cross sectional reduction rate (%)) was measured at a strain rate of 1/s at 1100° C., and the Charpy impact toughness was measured at −196° C. The surface irregularities, as illustrated in FIGS. 5 and 6, were evaluated by bending the steel and observing with naked eye. FIG. 5 illustrates an example of a case in which surface irregularities occurred, and FIG. 6 illustrates an example of a case in which surface irregularities did not occur.

Figure 2:
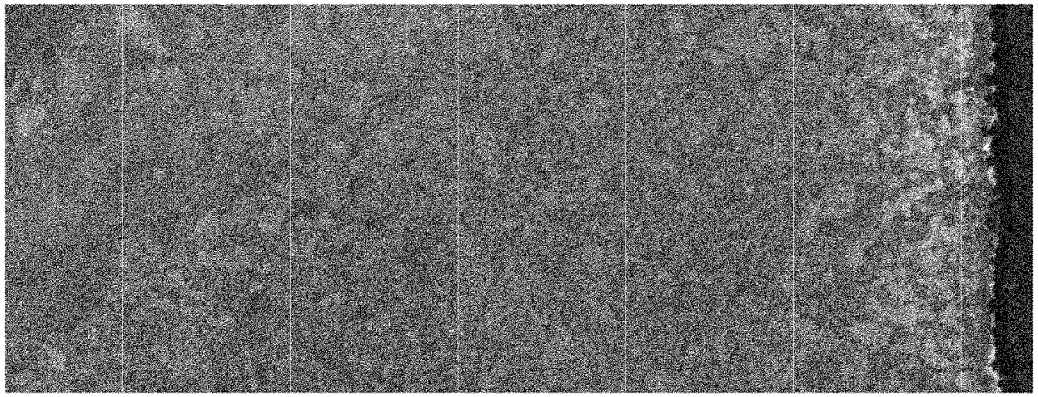

Meanwhile, Inventive Example 3, subject to forging, was observed with respect to the microstructure of the slab before and after forging, and a result thereof is shown in FIG. 1. FIG. 1 illustrates the slab microstructure before forging, and FIG. 2 illustrates the slab microstructure after forging.

Figure 3:
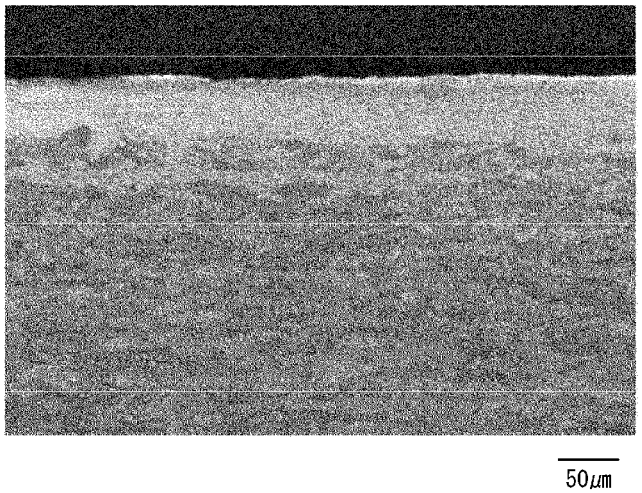
FIGS. 3 and 4 illustrate microstructures of a conventional steel and a steel appropriate to the present disclosure.
Figure 4:
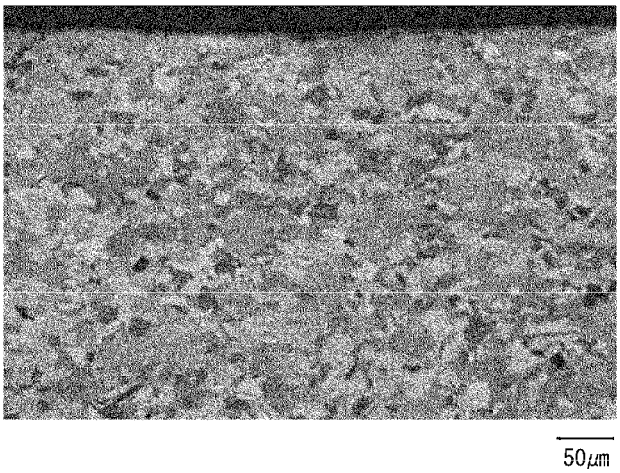

Inventive Example 3, to which the forging treatment is applied, and Comparative Example 2, to which the forging treatment is not applied, were observed with respect to the structure of the steel surface layer after hot rolling, and a result thereof is shown in FIGS. 3 and 4. FIG. 3 represents Comparative Example (2) and FIG. 4 represents Inventive Example (3).

TABLE 1

| | Steel composition (wt %) | | | | | | | | | | |
|---|---|---|---|---|---|---|---|---|---|---|---|
| Steel | C | Mn | Si | Al | Ti | Cr | Cu | S | P | N | B |
| 1 | 0.45 | 24.5 | 0.3 | 0.0271 | 0.031 | 3.7 | 0.50 | 0.0022 | 0.0178 | 0.0112 | 0.0029 |
| 2 | 0.45 | 24.5 | 0.3 | 0.0377 | 0.031 | 3.8 | 0.50 | 0.0012 | 0.0252 | 0.0134 | 0.0025 |
| 3 | 0.45 | 24.5 | 0.3 | 0.0362 | 0.032 | 3.7 | 0.48 | 0.0014 | 0.0239 | 0.0152 | 0.0026 |
| 4 | 0.45 | 24.5 | 0.3 | 0.0371 | 0.021 | 3.5 | 0.48 | 0.0007 | 0.027 | 0.0136 | 0.0025 |
| 5 | 0.45 | 24.5 | 0.3 | 0.0334 | 0.002 | 3.3 | 0.41 | 0.0013 | 0.0135 | 0.0201 | 0.0025 |
| 6 | 0.45 | 24.5 | 0.3 | 0.0278 | 0.029 | 3.6 | 0.53 | 0.0029 | 0.0192 | 0.0161 | 0.0018 |
| 7 | 0.45 | 24.5 | 0.3 | 0.0451 | 0.003 | 3.3 | 0.41 | 0.0010 | 0.0166 | 0.0172 | 0.0025 |
| 8 | 0.45 | 24.5 | 0.3 | 0.0266 | 0.029 | 3.3 | 0.42 | 0.0011 | 0.0164 | 0.0151 | 0.0028 |

TABLE 2

| Steel | Forging temp (1100° C.) | Forging thickness reduction rate | No. of slab surface layer coarse grain having grain size of 150 μm | Slab high temperature ductility (%) | Reheating temperature (° C.) | Finish rolling temperature (° C.) |
|---|---|---|---|---|---|---|
| 1 | Not App | — | 10 | 24 | 1200 | 930 |
| 2 | Not App | — | 5 | 35 | 1180 | 920 |
| 3 | App | 52 | 0.03 | 80 | 1180 | 800 |
| 4 | App | 28 | 0.1 | 89 | 1180 | 930 |
| 5 | App | 28 | 0.1 | 90 | 1200 | 930 |
| 6 | App | 28 | 0.1 | 87 | 1200 | 862 |
| 7 | App | 28 | 0.1 | 85 | 1220 | 860 |
| 8 | App | 28 | 0.1 | 80 | 1220 | 850 |

| Steel | Reduction rate at Tnr or lower (%) | Cooling speed (° C./sec) | Cooling termination temperature ((° C.) | Steel thickness (mm) | Miscellaneous |
|---|---|---|---|---|---|
| 1 | 35 | 25 | 380 | 21 | CE1 |
| 2 | 46 | 33.5 | 400 | 15 | CE2 |
| 3 | 45 | 8 | 400 | 20 | CE3 |
| 4 | 55 | 33.5 | 380 | 15 | IE1 |
| 5 | 30 | 23.9 | 372 | 27 | IE2 |

TABLE 2-continued

| | | | | | |
|---|---|---|---|---|---|
| 6 | 45 | 23.9 | 364 | 27 | IE3 |
| 7 | 55 | 23.9 | 391 | 27 | IE4 |
| 8 | 50 | 15 | 350 | 36 | IE5 |

*CE: Comparative Example,
**IE: Inventive Example

TABLE 3

| Type | No. of steel coarse grain having grain size of 50 μm or more (/cm$^2$) | No. of steel coarse grain having grain size of 30 μm or more (/cm$^2$) | Average grain size of steel (μm) | Precipitate percentage (vol %) | Yield strength (MPa) |
|---|---|---|---|---|---|
| 1 | 4 | 6 | 55 | <1% | 384 |
| 2 | 3 | 5 | 52 | <1% | 410 |
| 3 | 0.02 | 0.03 | 18 | 4% | 565 |
| 4 | 0.1 | 0.1 | 24 | <1% | 465 |
| 5 | 0.1 | 0.5 | 29 | <1% | 356 |
| 6 | 0.1 | 0.1 | 27 | <1% | 410 |
| 7 | 0.1 | 0.1 | 26 | <1% | 462 |
| 8 | 0.1 | 0.1 | 26 | <1% | 433 |

| Type | −196° C. Impact toughness (J, RD) | −196° C. Impact toughness (J, TD) | Anisotropy index | Surface irregularities | Misc. |
|---|---|---|---|---|---|
| 1 | 100 | 57 | 0.57 | Irr | CE1 |
| 2 | 151 | 85 | 0.56 | Irr | CE2 |
| 3 | 49 | 43 | 0.87 | Non-irr | CE3 |
| 4 | 146 | 122 | 0.84 | Non-irr | IE1 |
| 5 | 103 | 91 | 0.88 | Non-irr | IE2 |
| 6 | 130 | 119 | 0.92 | Non-irr | IE3 |
| 7 | 110 | 97 | 0.88 | Non-irr | IE4 |
| 8 | 100 | 101 | 1.01 | Non-irr | IE5 |

As indicated in Tables 1 to 3 above, Inventive Examples 1 to 4, which satisfy the steel composition and manufacturing conditions of the present invention, have less than 1 coarse grain having a grain size of 150 μm or more per cm$^2$ on the surface layer portion of the slab, and an average grain size of the steel is 50 μm or less, and a number of the coarse grain having a grain size of at least 50 μm and that of at least 30 μm are less than 1. In the case of Inventive Examples (1 and 3 to 5), not only are yield strength and impact toughness excellent, but also no surface irregularities occurred. In the case of Inventive Example 2, yield resistance was low but impact toughness was excellent and surface irregularities did not occur.

In the case of Inventive Examples 1 to 5, an average grain size of the steel was 50 μm or less, and a number of the coarse grains having a grain size of at least 50 μm was less than 1 per cm$^2$. Accordingly, surface irregularities may not occur even when processed as a final structure product, thereby giving rise to excellent surface quality.

In contrast, in the case of Comparative Examples 1 and 2, to which the forging treatment was not applied, showed 10 and 5 coarse grains having a grain size of 150 μm more per cm$^2$, respectively, which may give rise to surface irregularities. Furthermore, numbers of the coarse grains of the steel, having a grain size of at least 50 μm, are 4 and 3 per cm$^2$, respectively. This indicates that surface irregularities may occur when processed as a final structure product. As anisotropy indices of Comparative Examples 1 and 2 are less than 0.6, irregularity of physical properties may remarkably occur according to directionality of a material of the final structure product.

In the case of Comparative Example 3, of which the forging and cooling conditions do not meet the requirements of the present invention, an average grain size of the austenite structure is 18 μm, and a precipitate percentage is 4%. Accordingly, no surface irregularities occurred, but impact toughness was reduced.

As illustrated in FIG. 1, the microstructure of the coarse slab surface layer before forging has become more refined after forging.

Figure 7:
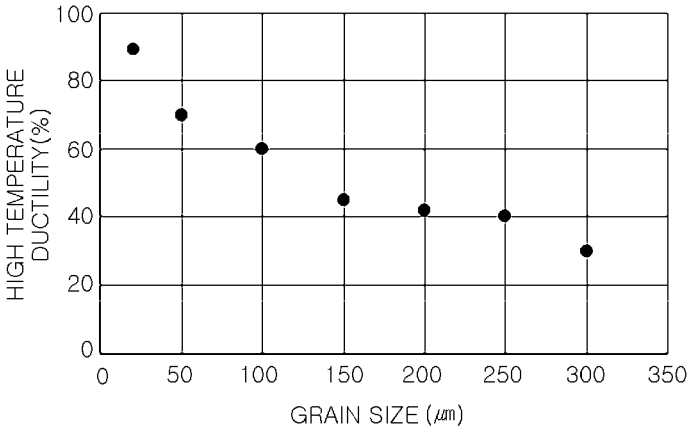
FIG. 7 is a graph illustrating a change in high temperature ductility of a slab according to a microstructure grain size of a surface layer of the slab.

The slab of Inventive Example 1 was subject to forging such that a grain size of the surface layer structure becomes that in FIG. 7 and was observed with respect to changes in high temperature ductility according to the grain size of the surface layer of the slab after forging. As illustrated in FIG. 7, a result indicates that the finer the grain size of the surface layer structure of the slab is, the more excellent the high temperature ductility of the slab is.

As shown in FIGS. 3 and 4, in the case of Inventive Example 3, to which the forging is applied according to the present invention, was shown to be more refined compared to Comparative Example 2, in which the steel structure was not forged after hot-rolled.

While exemplary embodiments have been shown and described above, the scope of the present disclosure is not limited thereto, and it will be apparent to those skilled in the art that modifications and variations could be made without departing from the scope of the present invention as defined by the appended claims.

The invention claimed is:

1. A high manganese steel for low temperature applications, comprising:

0.3 wt % to 0.8 wt % of C, 18 wt % to 26 wt % of Mn, 0.01 wt % to 1 wt % of Si, 0.01 wt % to 0.5 wt % of Al, 0.1 wt % or less of Ti (excluding 0%), 1 wt % to 4.5 wt % of Cr, 0.1 wt % to 0.9 wt % of Cu, 0.03 wt % or less of S (excluding 0%), 0.3 wt % or less of P (excluding 0%), 0.001 wt % to 0.03 wt % of N, 0.004 wt % or less of B (excluding 0%), and a remainder of Fe and other inevitable impurities, wherein a microstructure comprises an austenite single phase structure, an average grain size of the austenite is 50 μm or less, and a number of an austenite grain having a grain size of 50 μm or more is less than 1 per $Cm^2$.

2. The high manganese steel of claim 1, wherein an average grain size of the austenite structure is 20 μm to 30 μm.

3. The high manganese steel of claim 1, wherein, in the austenite structure, a number of austenite grains having a grain size of 30 μm or more is less than 1 per $cm^2$.

4. The high manganese steel of claim 1, wherein the high manganese steel has rolling direction impact toughness of 100 J or higher at −196° C.

5. The high manganese steel of claim 1, wherein the high manganese steel has an anisotropy index of 0.6 or higher, wherein the anisotropy index is a ratio of thickness direction impact toughness at −196° C. to rolling direction impact toughness at −196° C.

6. The high manganese steel of claim 1, wherein the high manganese steel has yield strength of 400 MPa or higher.

7. The high manganese steel of claim 1, wherein the high manganese steel is manufactured by a manufacturing method comprising preparing a slab having the composition of claim 1, reheating the slab and hot rolling the reheated slab, wherein a recrystallization structure having less than 1 grain having a grain size of 150 μm or more is formed per $cm^2$ on a surface layer portion (a region of the slab surface layer portion up to 2 mm from the surface in a slab thickness direction) of the slab before reheating.

8. The high manganese steel of claim 7, wherein an average grain size of the surface layer portion of the slab before reheating is 100 μm or less.

9. The high manganese steel of claim 7, wherein the slab before reheating has a cross-section reduction rate of at least 60% at 1100° C.

10. The high manganese steel of claim 1, wherein the high manganese steel has a thickness of 8.0 mm to 40 mm.

11. A method of manufacturing a high manganese steel for low temperature applications according to claim 1, the method comprising:

preparing a slab comprising 0.3 wt % to 0.8 wt % of C, 18 wt % to 26 wt % of Mn, 0.01 wt % to 1 wt % of Si, 0.01 wt % to 0.5 wt % of Al, 0.1 wt % or less of Ti (excluding 0%), 1 wt % to 4.5 wt % of Cr, 0.1 wt % to 0.9 wt % of Cu, 0.03 wt % or less of S (excluding 0%), 0.3 wt % or less of P (excluding 0%), 0.001 wt % to 0.03 wt % of N, 0.004 wt % or less of B (excluding 0%), and a remainder of Fe and other inevitable impurities;

deformation application involving applying a deformation to the slab such that a recrystallization microstructure is formed on a surface layer portion of the slab;

air cooling involving air-cooling the slab on which the recrystallization microstructure is formed on the surface layer portion thereof to room temperature;

reheating involving heating the air-cooled slab to 1100° C. to 1250° C.;

hot rolling involving finish-rolling the reheated slab at 850° C. to 950° C. to obtain a hot-rolled steel; and accelerated cooling involving accelerated-cooling the hot-rolled steel at a cooling speed of 10° C./sec or more to an accelerated cooling termination temperature of 600° C. or less.

12. The method of claim 11, wherein the deformation application is performed by rough rolling under a high reduction condition at 1000° C. to 1200° C.

13. The method of claim 11, wherein the deformation application is performed by high temperature forging at 1000° C. to 1200° C.

14. The method of claim 11, wherein the deformation application is performed such that a number of grains having a grain size of at least 150 μm on the surface layer portion (a region of the slab surface layer portion up to 2 mm from the surface in a slab thickness direction) is less than 1 per $cm^2$ by rough rolling under a high reduction condition at 1000° C. to 1200° C.

15. The method of claim 11, wherein an average grain size of the surface layer portion of the slab after the deformation application is 100 μm or less.

16. The method of claim 11, wherein the deformation application is performed such that a thickness reduction rate is 15% to 50% for an initial slab.

17. The method of claim 11, wherein, in the hot rolling, a final pass rolling temperature during hot finish rolling is 850° C. or above and less than 900° C. when a final thickness of the steel is 18 mm or above, and a final pass rolling temperature during hot finish rolling is 900° C. to 950° C. when a final thickness of the steel is less than 18 mm.

18. The method of claim 11, wherein, in the hot rolling, a reduction ratio is 40% or more of a total reduction rate at a temperature below a non-recrystallization temperature (Tnr) when a final thickness of the steel is 18 mm or above.

19. The method of claim 11, wherein the hot-rolled steel has a thickness of 8 mm to 40 mm.

* * * * *